US009255368B1

(12) United States Patent
Doolittle

(10) Patent No.: US 9,255,368 B1
(45) Date of Patent: Feb. 9, 2016

(54) SNOW SHOVER

(71) Applicant: Allen Doolittle, Nashville, TN (US)

(72) Inventor: Allen Doolittle, Nashville, TN (US)

( * ) Notice: Subject to any disclaimer, the term of this patent is extended or adjusted under 35 U.S.C. 154(b) by 6 days.

(21) Appl. No.: 14/332,559

(22) Filed: Jul. 16, 2014

(51) Int. Cl.
*E01H 5/02* (2006.01)
*E01H 5/06* (2006.01)

(52) U.S. Cl.
CPC ..... *E01H 5/02* (2013.01)

(58) Field of Classification Search
CPC ..... E01H 5/02; E01H 5/00; A01B 1/00; A01B 1/022; A01B 1/22; A01B 1/222; E01F 5/06
See application file for complete search history.

(56) References Cited

U.S. PATENT DOCUMENTS 1,375,505 A * 4/1921 Grady ..... E01H 5/02 37/284
1,666,334 A * 4/1928 Larson ..... E01H 5/02 37/280
1,746,859 A 8/1931 Cooper
2,388,985 A * 11/1945 Martin ..... E01H 5/02 37/283
2,826,835 A 6/1953 O'Shea
2,653,397 A * 9/1953 Butler ..... E01H 5/02 172/252
2,862,315 A * 12/1958 Blanchet ..... E01H 5/06 172/817
2,900,744 A * 8/1959 Champain ..... E01H 5/02 172/654
2,967,363 A * 1/1961 Meier ..... E01H 5/02 294/53.5
3,431,661 A * 3/1969 Carlson ..... E01H 5/02 294/57
3,608,216 A * 9/1971 Prescott ..... E01H 5/06 172/80
4,878,704 A * 11/1989 Jacanin, Jr. ..... E01H 5/02 294/51
4,910,893 A * 3/1990 Asay ..... A01K 1/10 172/364
4,944,541 A 7/1990 Waldschmidt
4,991,324 A * 2/1991 Fine ..... E01H 5/02 294/54.5
5,048,883 A * 9/1991 Waluk ..... E01H 5/02 294/54.5
5,431,468 A 7/1995 Rosenshine
5,791,072 A 8/1998 Schbot
6,053,548 A 4/2000 Bowles, Jr.
7,237,814 B2 * 7/2007 Handzlik ..... E01H 5/02 294/51
7,681,933 B2 3/2010 Chesness
8,800,175 B1 * 8/2014 Faraci ..... E01H 5/02 294/54.5
9,187,872 B1 * 11/2015 Hermanson ..... E01H 5/02
2005/0012348 A1 1/2005 Handzlik
2006/0249964 A1 * 11/2006 Brazeau ..... E01H 5/02 294/54.5

* cited by examiner

*Primary Examiner* — Thomas B Will
*Assistant Examiner* — Joan D Misa
(74) *Attorney, Agent, or Firm* — Dennis L. Thomte; Thomte Patent Law Office LLC

(57) ABSTRACT

A snow shover including a scraper blade with a pair of spaced-apart push handles extending rearwardly therefrom. The push handles are pivotally secured to the blade about generally vertical axes. The push handles are length adjustable.

4 Claims, 8 Drawing Sheets

SNOW SHOVER

BACKGROUND OF THE INVENTION

1. Field of the Invention

This invention relates to a snow shover or pusher having a pair of elongated handles pivotally secured to the rearward side of a blade. More particularly this invention relates to a snow shover wherein each of the handles thereof is length adjustable. Even more particularly, this invention relates to a snow shover which is designed to laterally move large volumes of snow.

2. Description of the Related Art

Many types of snow shovels and snow blades have been previously provided. For example, U.S. Pat. No. 1,746,859 illustrates a scraper which is V-shaped and which pushes the snow in both directions from the center. This design makes it very difficult to scrape driveways or sidewalks next to a building or fence. U.S. Pat. No. 2,826,835 discloses a snow shovel wherein the pushing force is directed to the center of the scraper blade and is designed to push the snow directly forwardly. U.S. Pat. No. 7,681,933 discloses a shovel with a crossbar handle. It appears that this shovel is very heavy with many moving parts.

U.S. Published Patent Application 2005/001232448 A1 discloses a snow shoveling device which is apparently designed to move snow only directly forwardly. The movement of snow directly forwardly, as in this device, is only possible for short distances before it become impossible to proceed due to the weight of the snow.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A snow shover is disclosed which includes an elongated blade having a concave front side, a convex rear side, an upper edge, a lower edge, a first end and a second end. A first upper mount is secured to the rear side of the blade inwardly of the first end thereof below the upper edge thereof and which extends rearwardly from the rear side of the blade. The lower end of the first upper mount has a cylindrical opening formed therein which extends upwardly thereinto. A first lower mount is secured to the rear side of the blade directly below the first upper mount and which extends rearwardly from the rear side of the blade above the lower edge of the blade. The first lower mount has a vertically disposed bore, having upper and lower ends, formed therein which extends therethrough. An upstanding first pivot shaft is disclosed which has upper and lower ends. The upper end of the first pivot shaft is pivotally received in the cylindrical opening in the lower end of the first upper mount.

A first mounting structure is disclosed which includes a first tee fitting is provided which has an open upper end, an open lower end, and an open side end. The open upper end of the first tee fitting is secured to the lower end of the first pivot shaft above the first lower mount. The open lower end of the first tee fitting is pivotally received in the bore of the first lower mount. A generally vertically disposed first shaft has its upper end secured to the lower end of the first tee fitting. A first 90 degree elbow, having first and second ends, has its first end secured to the lower end of the first shaft. The second end of the first elbow extends laterally rearwardly. The forward end of a horizontally extending second shaft is secured to the second end of the first elbow and extends rearwardly therefrom. The forward end of a second elbow, which is a 45 degree elbow, is secured to the rearward end of the second shaft. The rearward end of the second elbow is secured to the lower end of a third shaft. A third elbow, which is a 90 degree elbow, has its lower end secured to the upper end of the third shaft. A fourth shaft has its lower end secured to the upper end of the third elbow. The upper end of the fourth shaft is secured to the side end of a second tee fitting. The lower end of the second tee fitting has the upper end of a fifth shaft secured thereto. The lower end of the fifth shaft is secured to the rearward end of a fourth elbow, which is a 45 degree elbow. A sixth shaft connects the forward end of the fourth elbow to the side end of the first tee fitting. The lower forward end of an elongated first push handle is secured to the upper rearward end of the second tee fitting. Preferably, the first push handle is length adjustable.

Although the first mounting structure is described as including several individual parts or components, it is preferred that all the parts or components of the first mounting structure as well as the first pivot shaft be of one-piece or single-piece construction.

A second upper mount is secured to the rear side of the blade inwardly of the second end thereof below the upper edge thereof and which extends rearwardly from the rear side of the blade. The lower end of the second upper mount has a cylindrical opening formed therein which extends upwardly thereinto. A second lower mount is secured to the rear side of the blade directly below the second upper mount. The second lower mount has a vertically disposed bore, having upper and lower ends, formed therein which extends therethrough. An upstanding second pivot shaft is disclosed which has upper and lower ends. The upper end of the second pivot shaft is pivotally received in the cylindrical opening in the lower end of the second upper mount.

A second mounting structure is disclosed which includes a third tee fitting is provided which has an open upper end, an open lower end, and an open side end. The open upper end of the third tee fitting is secured to the lower end of the second pivot shaft above the second lower mount. The open lower end of the third tee fitting is pivotally received in the bore of the second lower mount. A generally vertically disposed seventh shaft has its upper end secured to the lower end of the third tee fitting. A fifth elbow, which is a 90 degree elbow with first and second ends, has its first end secured to the lower end of the seventh shaft. The second end of the fifth elbow extends laterally rearwardly. The forward end of a horizontally disposed eighth shaft is secured to the second end of the fifth elbow and extends rearwardly therefrom. The forward end of a sixth elbow, which is a 45 degree elbow, is secured to the rearward end of the eighth shaft. The rearward end of the sixth elbow is secured to the lower end of a ninth shaft. A seventh elbow, which is a 90 degree elbow, has its lower end secured to the upper end of the ninth shaft. A tenth shaft has its lower end secured to the upper end of the seventh elbow. The upper end of the tenth shaft is secured to the side end of a fourth tee fitting. The lower end of the fourth tee fitting has the upper end of an eleventh shaft secured thereto. The lower end of the eleventh shaft is secured to the rearward end of an eighth elbow, which is a 45 degree elbow. A twelfth shaft connects the forward end of the eighth elbow to the side end of the third tee fitting. The lower forward end of an elongated second push handle is secured to the upper rearward end of the fourth tee fitting. Preferably, the second push handle is length adjustable.

Although the second mounting structure is described as including several individual parts or components, it is preferred that all the parts or components of the second mounting structure as well as the second pivot shaft be of one-piece or single-piece construction.

It is therefore a principal object of the invention to provide an improved snow shover.

A further object of the invention is to provide a snow shover wherein first and second length adjustable push handles are secured to a scraper blade inwardly of the opposite ends thereof.

A further object of the invention is to provide a snow shover of the type described which enables the scraper blade thereof to be angularly disposed with respect to the direction of movement of the snow shover.

A further object of the invention is to provide a snow shover of the type described which is lightweight and easy to maneuver.

A further object of the invention is to provide a snow shover of the type described which enables the snow shover to be pivotally moved above an obstruction in the surface being cleared.

A further object of the invention is to provide a snow shover of the type described wherein the push handles thereof maybe folded from operative to inoperative or storage positions.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
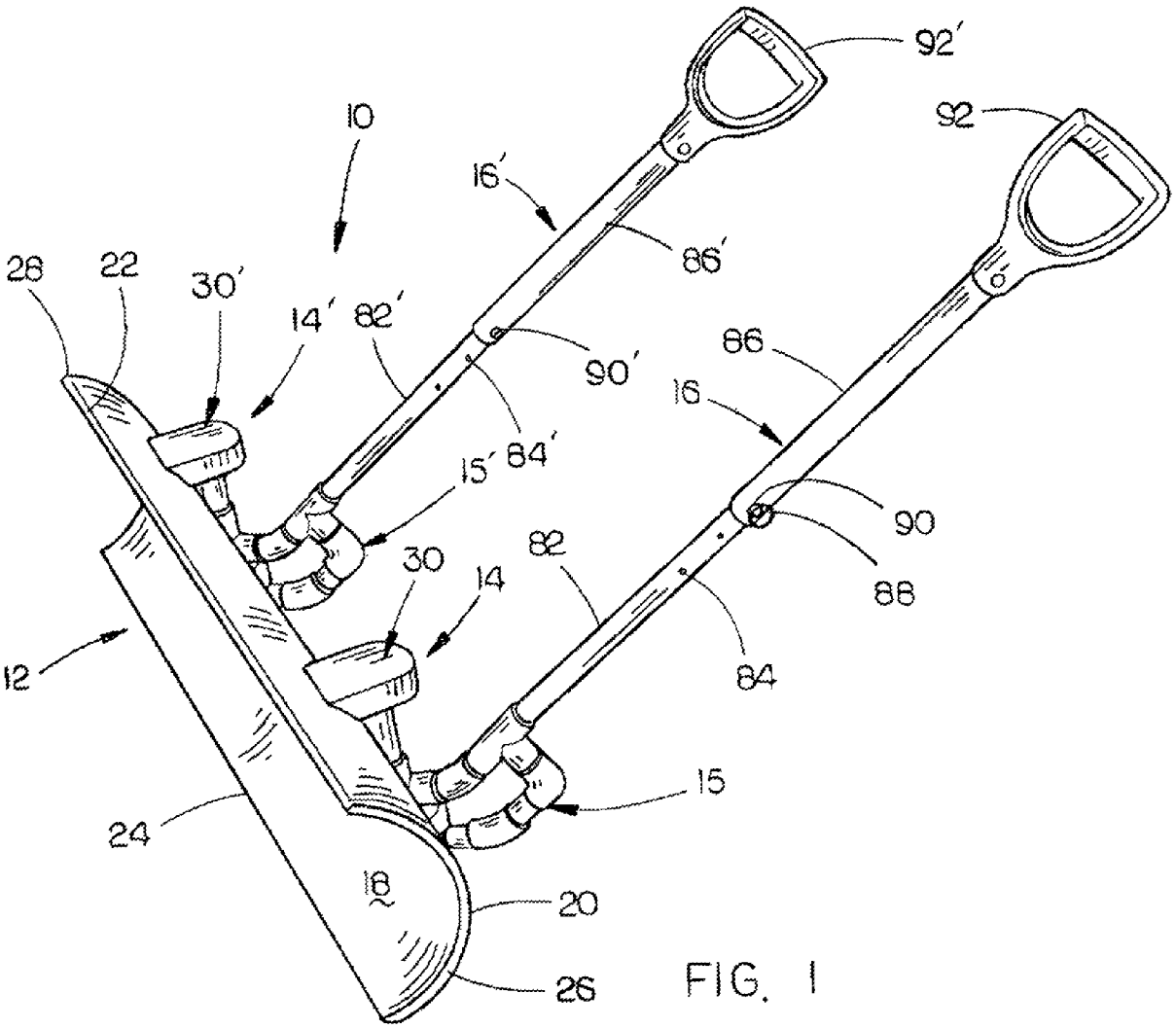
FIG. 1 is a perspective view of the snow shover of this invention.
Figure 2:
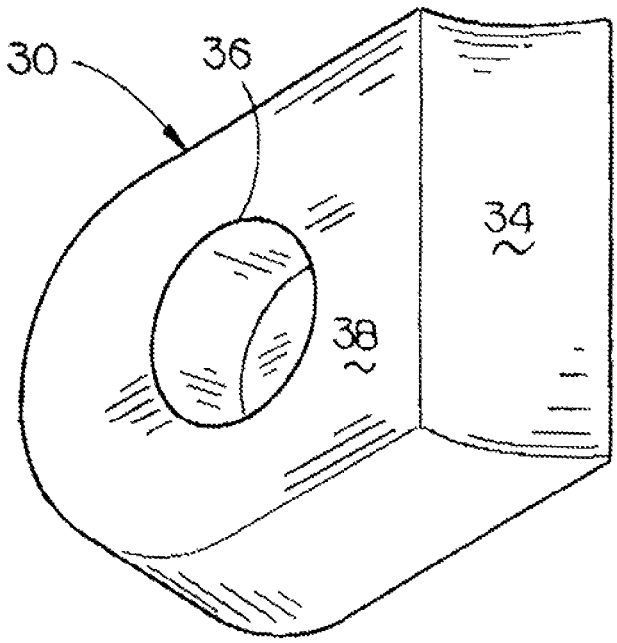
FIG. 2 is a lower perspective view of one of the upper mounts of this invention.
Figure 3:
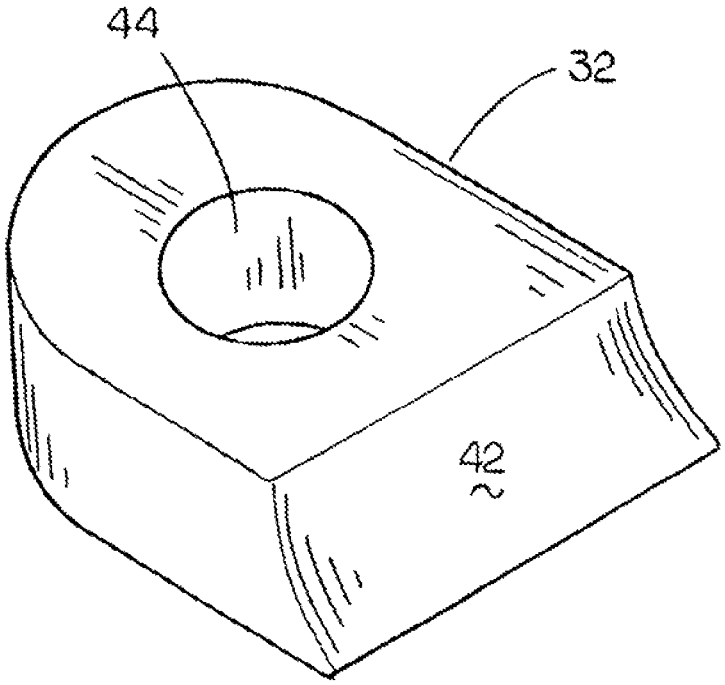
FIG. 3 is an upper perspective view of one of the lower mounts of this invention.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The snow shover or pusher of this invention is designated by the reference numeral 10. Snow shover 10 generally includes a blade 12, a first pivot mount assembly 14, a second pivot mount assembly 14', a first mounting structure 15, a second mounting structure 15', a first handle assembly 16 and a second handle assembly 16'. Inasmuch as pivot mount assemblies 14 and 14' are identical, only pivot mount assembly 14 will be described in detail with "'" indicating identical structure on pivot mount assembly 14'. Inasmuch as mounting structures 15 and 15' are identical, only mounting structure 15 will be described in detail with "'" indicating identical structure on mounting structure 15'. Inasmuch as handle assemblies 16 and 16' are identical, only handle assembly 16 will be described in detail with "'" indicating identical structure on handle assembly 16'.

Blade 12 includes a concave front side 18 and a convex back side 20. Although it is preferred that front side 16 be concave in shape and that back side 18 be convex in shape, the front and back sides could have other arcuate shapes. Blade 12 has an upper end 22, a lower end or edge 24, a first or left end 26 and a second or right end 28. Blade 12 may be comprised of any material such as aluminum, steel, or PVC.

The first pivot mount assembly 14 includes an upper mount 30 and a lower mount 32. Upper mount 30 has a forward end 34 which has a shape complementary to the back side 20 of blade 12. The forward end 34 of mount 30 is secured to the back side 20 of blade 12 by any convenient means such as adhesive, screws, etc. Mount 30 is positioned below the upper end 22 of blade 12 inwardly of end 26 of blade 12. Mount 30 has a cylindrical opening or bore 36 extending upwardly into mount 30 from the lower end 38 thereof.

Lower mount 32 has a forward end 42 which has a shape complementary to the back side 20 of blade 12. The forward end 42 of lower mount 32 is secured to the back side 20 of blade 12 by any convenient means such as adhesive, screws, etc. Mount 32 is positioned directly below mount 30. Mount 32 has a generally vertically disposed cylindrical opening or bore 44 extending therethrough which is directly below opening 36 in mount 30.

Mounting structure 15 includes a generally vertically disposed pivot shaft 46 having an upper end 48 and a lower end 50. The upper end 48 of pivot shaft 46 is pivotally received in sleeve 40. The lower end 50 of pivot shaft 46 is secured to the upper end 52 of a tee fitting 54. The lower end 56 of tee fitting 52 is partially received in bore 44. A shaft 58 has its upper end received in and secured to the lower end 56 of tee fitting 52. The lower end of shaft 58 is received by and secured to the upper end 60 of an elbow 62.

Figure 4:
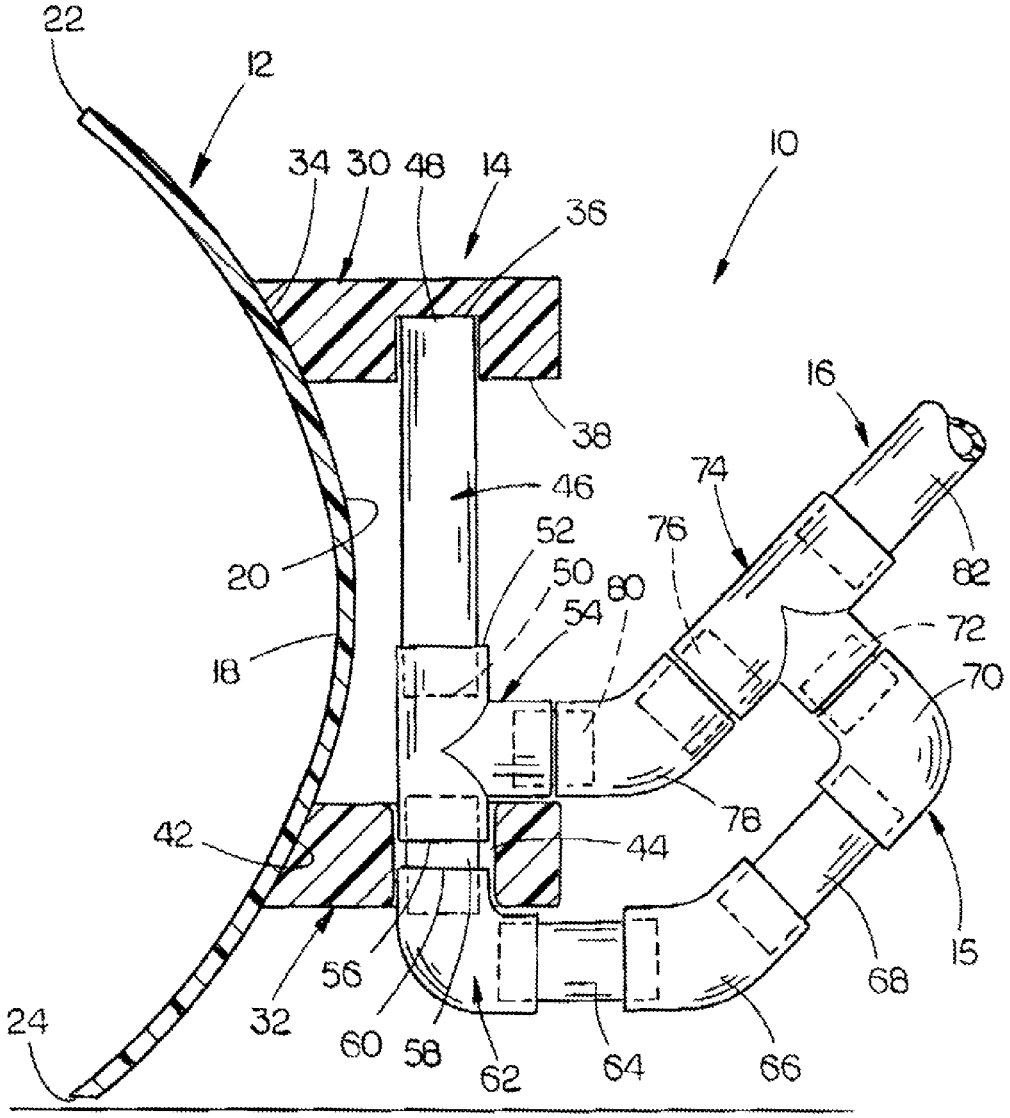
FIG. 4 is a partial sectional view of the snow shover of this invention.
Figure 5:
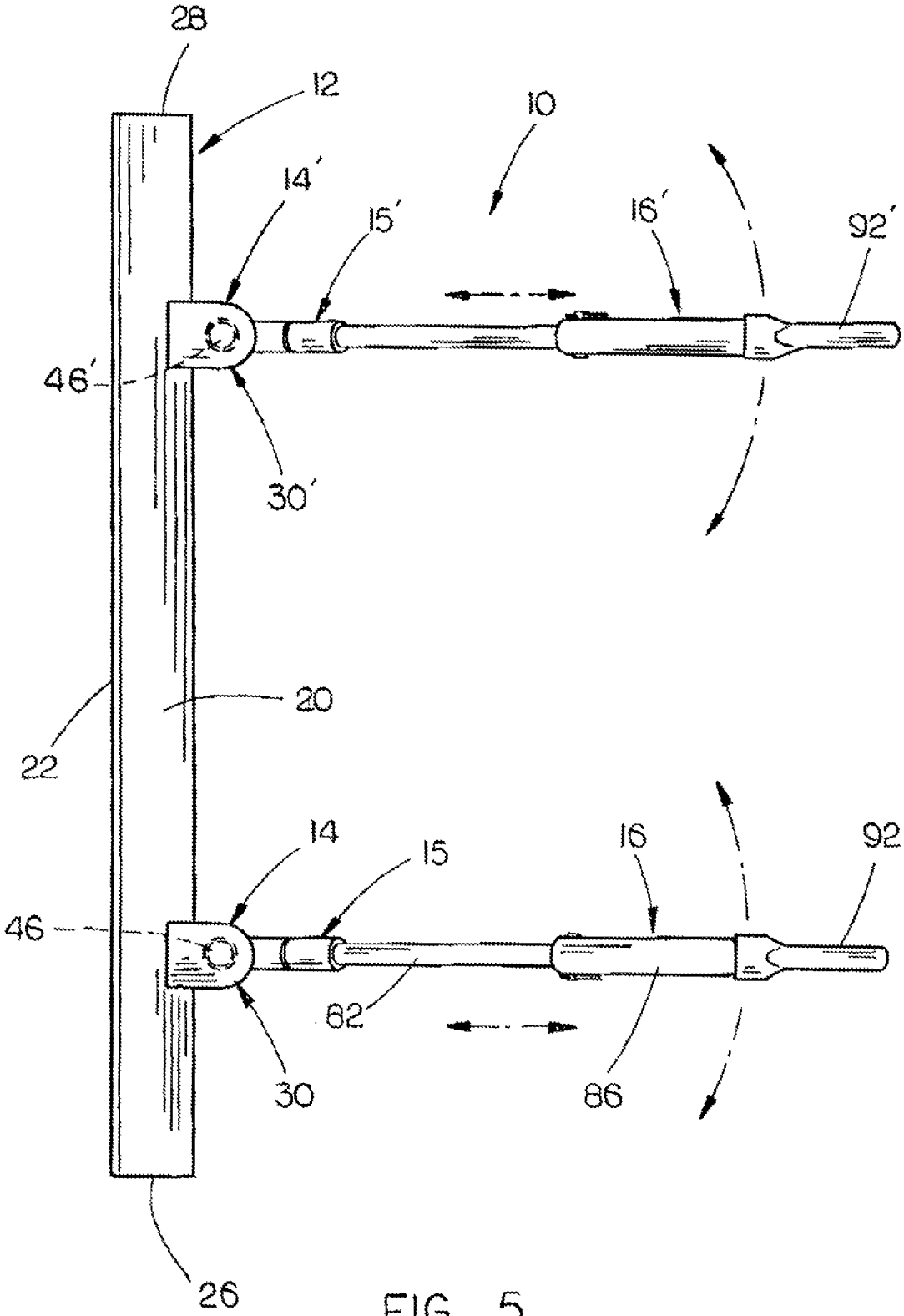
FIG. 5 is a top elevational view of the snow shover of this invention.

The forward end of shaft 64 is received by and secured to the lower end of the 90 degree elbow 62. The rearward end of shaft 64 is secured to the forward end of a 45 degree elbow 66. The rearward end of elbow 66 receives a shaft 68 which is secured thereto. One end of a 90 degree elbow 70 is secured to the upper end of shaft 68 as seen in FIG. 4. A short shaft 72 is received in the upper end of elbow 70 and has a tee fitting 74 secured thereto. A short shaft 76 has one end received by the tee fitting 74 as seen in FIG. 4. The other end of shaft 76 is received by and is secured to one end of a 45 degree elbow 78. A shaft 80 interconnects elbow 76 and the tee fitting 54 as seen in FIG. 4. Although mounting structure 15 is shown as being comprised of several parts or components, it is preferred that mounting structure 15 be of single unit construction for ease of manufacture.

Handle assembly 16 includes an elongated, tubular portion 82, the lower end of which is received in tee fitting 74 and which is secured thereto. Tubular portion 82 includes a plurality of spaced-apart openings 84 formed therein. Handle assembly 16 also includes an elongated, tubular portion 86 which selectively slidably receives tubular portion 82 therein. Tubular portion 86 has a pin 88 which extends through a pin opening 90 in tubular portion 86 into one of the openings 84 in tubular portion 82 to permit the length of handle assembly 16 to be selectively changed. A D-shaped handle grip 92 is secured to the outer end of tubular portion 86. The primary reason for having the handle assembly 16 length adjustable is to accommodate persons of different heights. In the drawings, the numeral 94 refers to a concrete surface which has snow thereon. The numeral 96 refers to a raised portion in the concrete surface 94.

Figure 6:
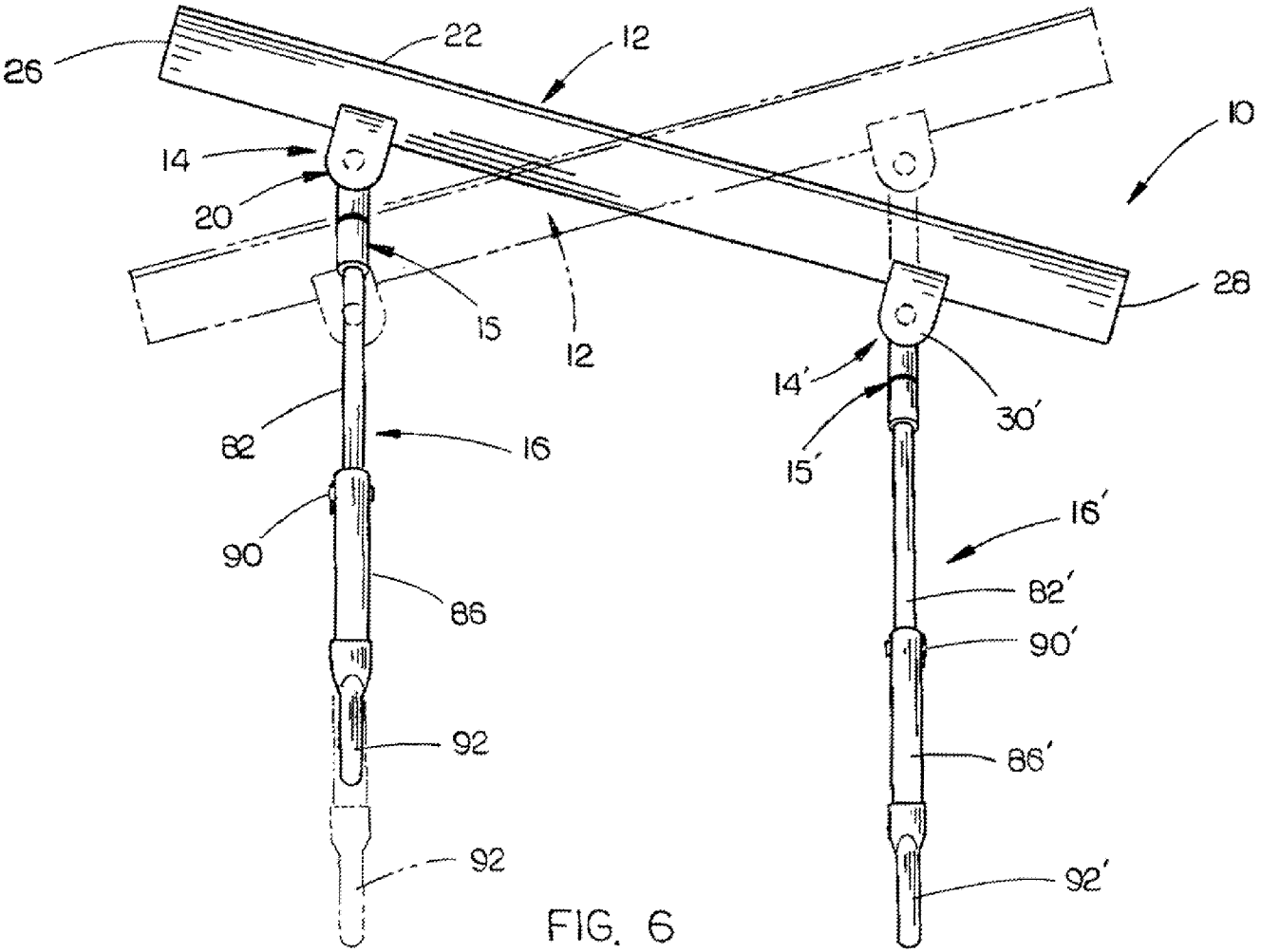
FIG. 6 is a view similar to FIG. 5 except that the blade is shown in an angled position with the broken lines indicating the blade in another angled position.
Figure 7:
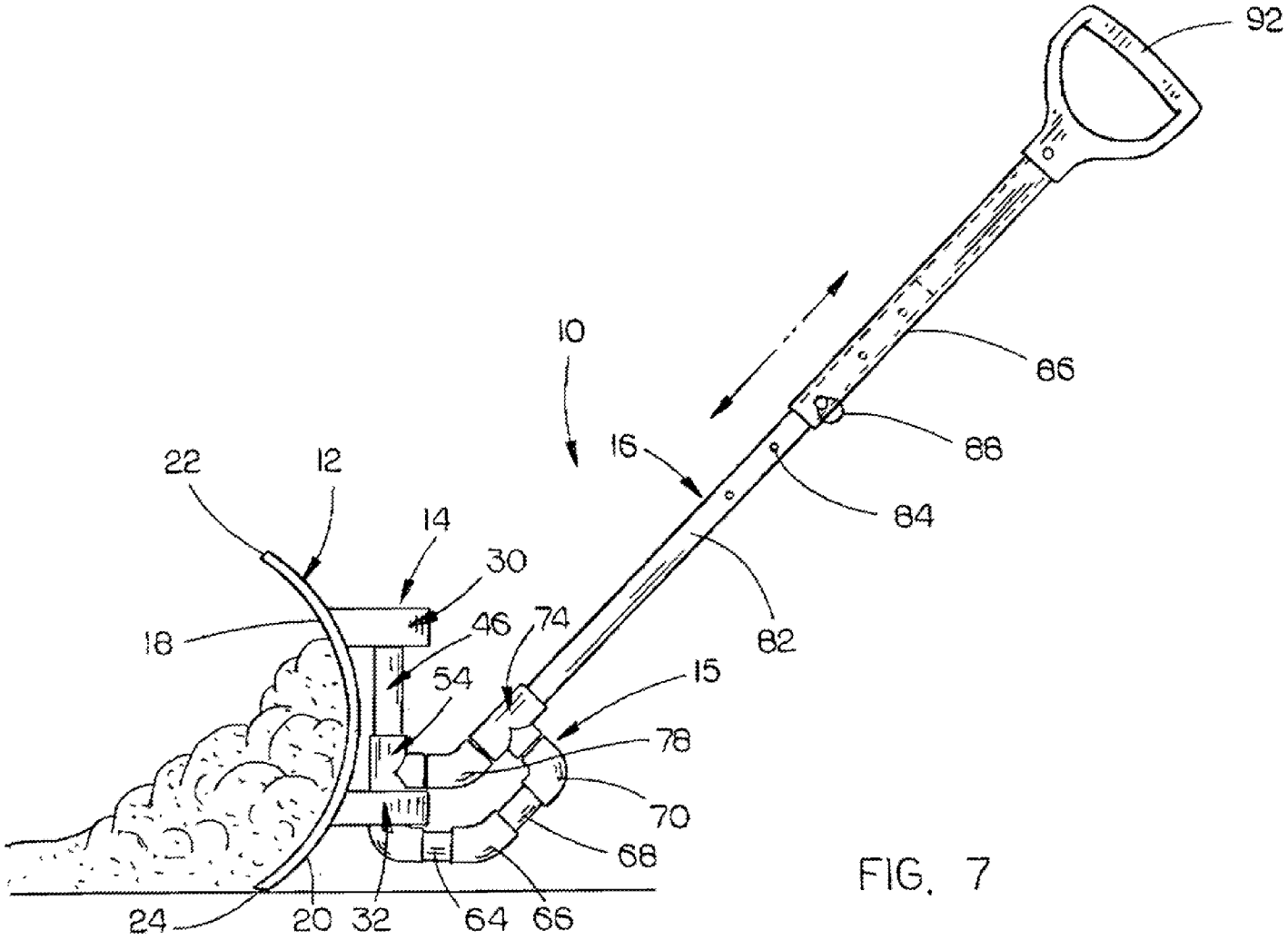
FIG. 7 is a side view illustrating the snow shover pushing snow.
Figure 8:
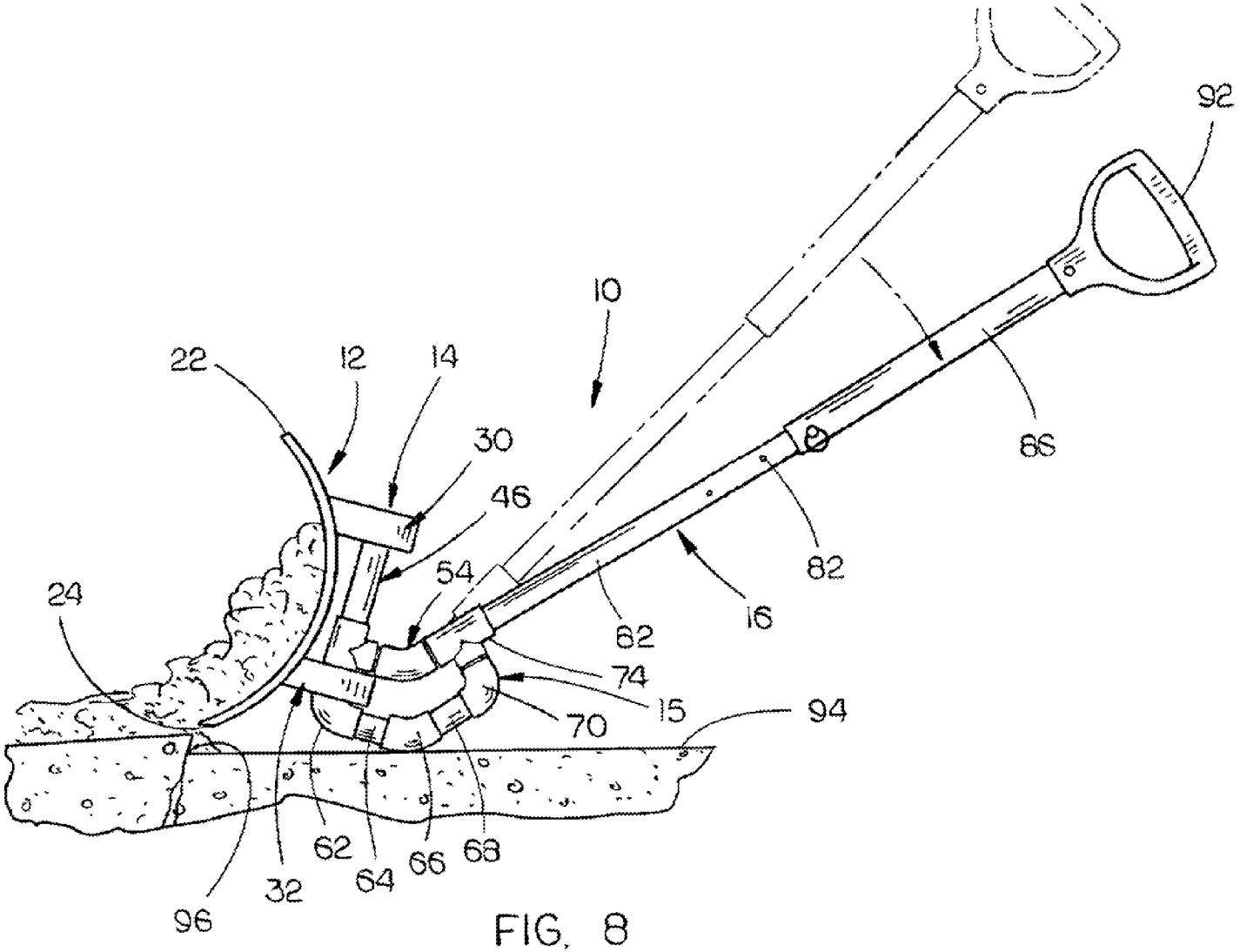
FIG. 8 is a view similar to FIG. 7 except that the snow shover has been moved upwardly to pass over an obstruction in the surface being cleared of snow.

The snow shover is used as follows. If the blade 12 is going to be used in an angularly disposed manner, which is usually the case, such as seen in FIG. 6, the length of handle assembly 16 may be increased if so desired so that the handle grips 92 and 92' will be aligned. Normally, the handle assemblies 16 and 16' will not have their lengths adjusted in response to an angular position of the blade 12. The operator then pushes the blade 12 forwardly so that snow will be pushed to the right from blade 12, as seen in FIG. 6. If snow is to be pushed to the left, the blade 12 is angled as shown by broken lines in FIG. 6. The pivot shafts 46 and 46' enable the handle assemblies to be parallel to the direction of travel even though the blade 12 is angularly disposed.

If the blade 12 should engage an obstruction 96, the operator simply lowers the handle assemblies 16 and 16' so that elbows 66 and 66' engage the surface 94 to pivotally move blade 12 upwardly to avoid the obstruction 96.

Figure 9:
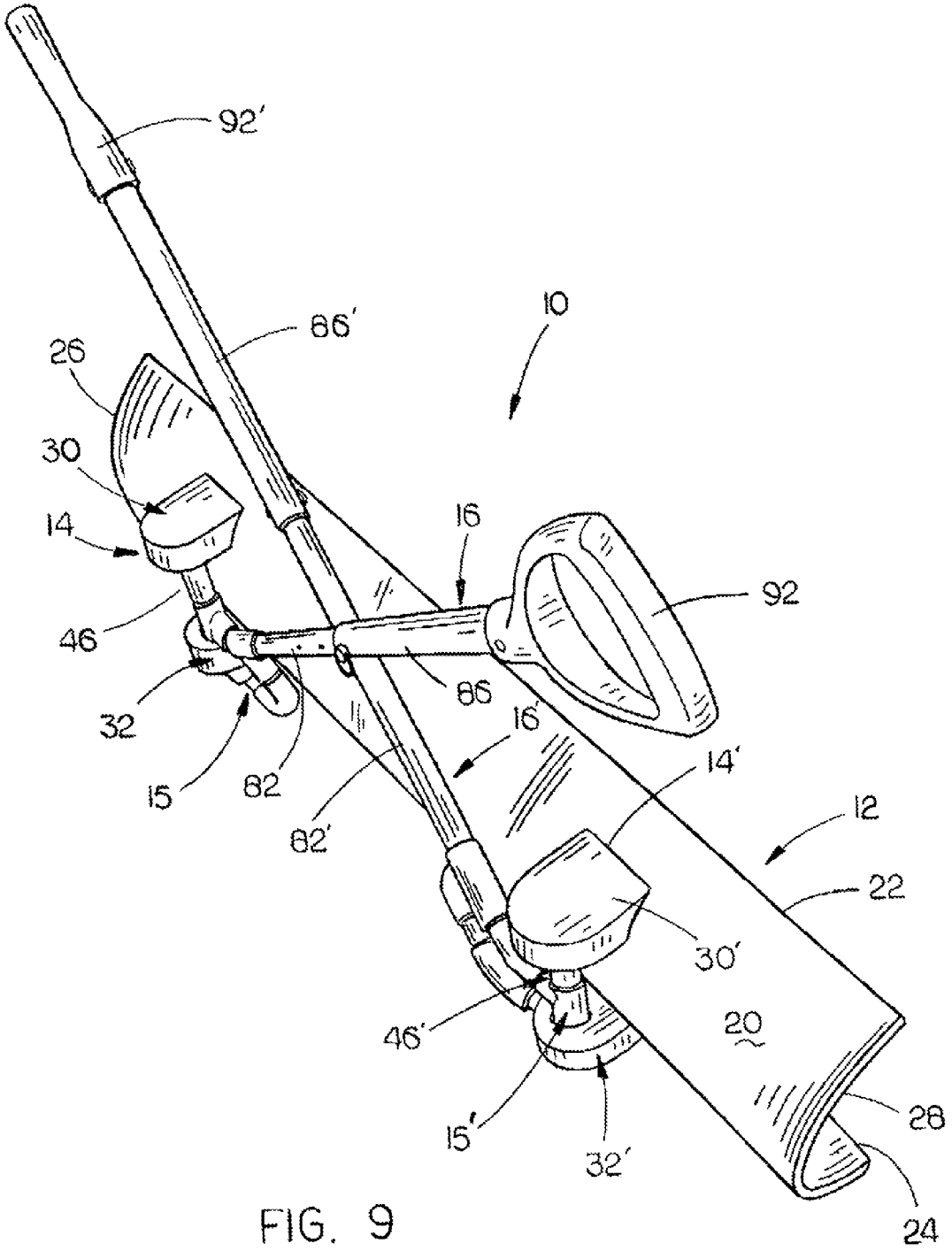
FIG. 9 is a perspective view illustrating the push handles in a folded position.

It can therefore be seen that the snow shover of this invention is extremely easy to use with the blade 12 being angled as desired. The push handle assemblies 16 and 16' may be easily pivoted from a working position to the storage position of FIG. 9

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A snow shover, comprising:

an elongated blade having a curved front side, a curved rear side, an upper edge, a lower edge, a first end and a second end;

a first upper mount secured to said rear side of said blade inwardly of said first end of said blade and below said upper edge of said blade and which extends rearwardly from said rear side of said blade;

a first lower mount secured to said rear side of said blade directly below said first upper mount and which extends rearwardly from said rear side of said blade above said lower edge of said blade;

a first mounting structure including an upstanding first pivot shaft having upper and lower ends;

said upper end of said first pivot shaft being pivotally secured about a generally vertical axis to said first upper mount;

said lower end of said first pivot shaft being operatively pivotally secured about a generally vertical axis to said first lower mount;

an elongated first push handle having forward and rearward ends;

said forward end of said first push handle being operatively fixed to said first pivot shaft;

said first push handle extending upwardly and rearwardly from said first mounting structure;

a second upper mount secured to said rear side of said blade inwardly of said second end of said blade and below said upper edge of said blade and which extends rearwardly from said rear side of said blade;

a second lower mount secured to said rear side of said blade directly below said second upper mount which extends rearwardly from said rear side of said blade above said lower edge of said blade;

a second mounting structure including an upstanding second pivot shaft having upper and lower ends;

said upper end of said second pivot shaft being operatively pivotally secured about a generally vertical axis to said second upper mount;

said lower end of said second pivot shaft being operatively pivotally secured about a generally vertical axis to said second lower mount;

an elongated second push handle having forward and rearward ends;

said forward end of said second push handle being operatively fixed to said second pivot shaft;

said second push handle extending upwardly and rearwardly from said second mounting structure;

each of said first and second mounting structures comprising a first tee fitting having an upper end, a lower end and a side end;

said upper end of said first tee fitting being secured to said lower end of the respective pivot shaft above the respective lower mount;

said lower end of said first tee fitting being pivotally received in a bore formed in the respective lower mount;

a rearwardly extending first support, having forward and rearward ends;

said forward end of said first support being operatively secured to said lower end of said first tee fitting;

said first support having a laterally extending portion which dwells in a plane below the respective lower mount;

a second support, having lower and upper ends, extending upwardly and rearwardly from said rearward end of said laterally extending portion of said first support;

a second tee fitting having an upper end, a lower end, and a side end;

said side end of said tee fitting being secured to said upper end of said second support;

a third support having forward and rearward ends;

said forward end of said third support being fixed to said side end of said first tee fitting; and the respective elongated push handle being secured to said upper end of said second tee fitting.

2. The snow shover of claim 1 wherein said push handle is length adjustable.

3. The snow shover of claim 1 wherein a D-shaped handle grip is secured to said push handle.

4. The snow shover of claim 1 wherein said first support is positioned in a plane above said lower end of said blade.

* * * * *